US006289529B1

(12) United States Patent
Harvey

(10) Patent No.: US 6,289,529 B1
(45) **Date of Patent: *Sep. 18, 2001**

(54) SHOWER SEAT AND BASKET COMBINATION

(76) Inventor: Brian Harvey, 17490 Meandering Way #106, Dallas, TX (US) 75252

( * ) Notice: Subject to any disclaimer, the term of this patent is extended or adjusted under 35 U.S.C. 154(b) by 0 days.

This patent is subject to a terminal disclaimer.

(21) Appl. No.: 09/353,970

(22) Filed: Jul. 15, 1999

Related U.S. Application Data

(63) Continuation-in-part of application No. 09/226,385, filed on Jan. 6, 1999, now Pat. No. 6,052,845.

(51) Int. Cl.[7] ..... A47K 3/28
(52) U.S. Cl. ..... 4/605; 4/559; 4/611; 211/119.009
(58) Field of Search ..... 4/290, 293, 444, 4/447, 553, 554, 559, 578.1, 579, 605, 611, 650, 651; 211/119.009, 119.011

(56) References Cited

U.S. PATENT DOCUMENTS

| | | | | |
|---|---|---|---|---|
| 62,734 | * | 3/1867 | Craigie | 4/651 |
| 246,973 | * | 9/1881 | Persson | 4/293 |
| 4,061,395 | | 12/1977 | Boole | 297/192 |
| 4,453,279 | | 6/1984 | Logsdon | 4/559 |
| 5,168,583 | * | 12/1992 | Wanke | 4/444 |
| 5,640,723 | | 6/1997 | Stanek | 4/578.1 |
| 6,052,845 | * | 4/2000 | Harvey | 4/611 |

FOREIGN PATENT DOCUMENTS

| | | | | |
|---|---|---|---|---|
| 8480 | * | 7/1928 | (AU) | 4/553 |
| 17457 | * | 12/1888 | (GB) | 4/559 |
| 28766 | * | 10/1898 | (GB) | 4/553 |
| 257771 | * | 9/1926 | (GB) | 4/553 |

* cited by examiner

*Primary Examiner*—Robert M. Fetsuga
(74) *Attorney, Agent, or Firm*—Smith, Danamraj & Youst, P.C.

(57) ABSTRACT

A shower seat and basket combination. The combination includes a basket which includes a horizontal bottom surface having four vertical sides forming an enclosure to hold shower supplies such as shampoo and soap. The basket also includes two overhanging edges located at a top portion of two opposing sides. The shower seat is a horizontally mounted flat surface mounted to a plurality of walls of the shower stall. On the underside of the shower seat is two railings running from a front portion of the seat to a back portion of the seat. The railings each include a lip to support each overhanging edge. The basket is positioned under the shower seat when not in use. When shower supplies are needed, the basket can be slid outwardly from the shower seat to access the interior of the basket. The basket may also include a plurality of perforations to allow water to drain from the basket. Additionally, a plurality of baskets may be stacked under the shower seat.

5 Claims, 5 Drawing Sheets

SHOWER SEAT AND BASKET COMBINATION

This utility patent application is a continuation-in-part application of Utility patent application Ser. No. 09/226,385 filed Jan. 6, 1999, U.S. Pat. No. 6,052,845, which is hereby incorporated in its entirety by reference herein.

BACKGROUND OF THE INVENTION

1. Technical Field of the Invention

This invention relates to a shower seat and basket combination, and more particularly, a basket slidably attached to a horizontal seat in a shower stall.

2. Description of Related Art

The problems associated with storing and placing shower supplies, such as soaps, brushes, shampoos, within a shower stall are well know to the public. Typically, when there is no storage area available, the shower supplies are placed on the floor of the shower stall. When shower supplies are placed on the floor, a person must bend over to retrieve the desired items. This can be extremely difficulty for the elderly or disabled. Additionally, the shower supplies take up precious surface area on the floor of the shower stall, causing unwanted clutter. However, when storage areas are used to store shower supplies, the storage areas take up precious volume within a space-limited shower stall.

In addition, shower seats are a popular means for adding convenience and ease in bathing within a shower stall. For example, in Utility patent application Ser. No. 09/226,385, a horizontal marble shower seat is permanently attached to the walls of the shower stall. A device is needed which provides an easily accessible area for storing shower supplies within a shower having a shower seat, without crowding the shower stall.

Although there are no known prior art teachings of a solution to the aforementioned deficiency and shortcoming such as that disclosed herein, prior art references that discuss subject matter that bears some relation to matters discussed herein are U.S. Pat. No. 4,061,395 to Boole (Boole), U.S. Pat. No. 4,453,279 to Logsdon (Logsdon), and U.S. Pat. No. 5,640,723 to Stanek (Stanek).

Boole discloses a portable drawer assembly for use with a four legged chair having a space between the legs. The assembly includes an enclosure having an open top and whose width is selectively adjustable for positioning in the space between the four legs. The enclosure is mounted on the four legs for allowing a sliding movement into and out of the space between the four legs. Although Boole discloses a drawer affixed to the bottom of a chair, Boole does not teach or suggest utilizing a basket attached to the underside of a shower seat. Additionally, Boole suffers from the disadvantage of utilizing a coil and rod system for allowing the drawer to slide out from the chair, which increases the complexity and expense in attaching a storage area to the underside of a horizontal surface.

Logsdon discloses a bath rack assembly for use in a bath or shower stall in combination with a bath seat appliance to store and retain toiletries and bathing materials within the reach of a person utilizing the bath seat appliance. The bath rack assembly is generally L-shaped and has an attachment bar which removably hooks onto the bath seat appliance and has a floor, back and at least one retaining bar to hold the toiletries and bathing materials on the bath rack assembly. In addition, the floor and back of the rack assembly are generally porous to prevent retention of bathing water. A retaining bar is provided for attachment of a razor blade shaving device. A horizontal grid apparatus is also attached to the retaining bar to provide storage for a bar of soap. Although Logsdon discloses a storage area mounted on a horizontal shower seat, Logsdon does not teach or suggest mounting a slidable storage area directly underneath the shower seat. In addition, Logsdon requires a rail assembly affixed to the shower seat to hold the storage area on the shower seat. In many instances, a rail assembly, as disclosed in Logsdon, is impractical or impossible to mount to the shower seat.

Stanek discloses a shower or bath stool having a storage area for toiletry items. The stool includes four non-skid legs, a movable top seating surface, and a storage space. The stool also includes a series of vents and drain holes for rapid drying and low humidity maintenance within the storage space. Additionally, a grooming aids mount is used for storing small items such as an electric shaver. The top cover provides a convex surface for shedding water and a peripheral flange for directing the water away from the stool and for shielding the ventilation holes. However, Stanek discloses a stool which is not permanently attached to the walls of the shower stall. Additionally, Stanek suffers from the disadvantage of requiring the top of the stool to be removed in order to access the interior of the storage area. Stanek does not teach or suggest a slidably mounted basket positioned on the underside of the shower seat.

Review of each of the foregoing references reveals no disclosure or suggestion of an apparatus as that described and claimed herein. Thus, it would be a distinct advantage to have an apparatus which easily and inexpensively attaches to the underside of a shower seat and provides easy access to shower supplies. It is an object of the present invention to provide such an apparatus.

SUMMARY OF THE INVENTION

In one aspect, the present invention is a basket and shower seat combination for use in a shower stall. The combination includes a shower seat horizontally mounted to a plurality of walls of the shower stall, and a basket slidably attached to the bottom side of the seat. The basket includes a generally horizontal bottom surface and four generally vertical sides affixed to the bottom surface. The four sides and bottom surface form an enclosure for storing shower supplies. The basket also includes two overhanging edges extending outwardly from a top portion of two opposing sides of the basket. In addition, the combination includes means for slidably supporting the two overhanging edges of the basket on the bottom side of the shower seat.

In another aspect, the present invention is a basket and shower seat combination for use in a shower stall. The combination includes a shower seat assembly having a cultured single pour marble slab and a shower stall having a plurality of vertical wall studs attached to a backboard of the shower stall in which a horizontal corner strip of backboard has been removed to form a slot. A back portion of the marble slab is inserted into the corner slot such that the edges are against the vertical wall studs. The shower stall also includes a plurality of tiles attached to the backboard adjacent a top side of the slab and a plurality of tiles attached to the backboard adjacent a bottom side of the slab. The slab rests on the tiles adjacent the top side and the bottom side of the slab and the backboard. The combination also includes a basket having a generally horizontal bottom surface and four generally vertical sides affixed to the bottom surface. The four sides and bottom surface form an enclosure for storing shower supplies. The basket also includes two overhanging edges extending outwardly from a top portion of two opposing sides of the basket. In addition, the combination includes means for slidably supporting the two overhanging edges of the basket on the bottom side of the slab.

In another aspect, the present invention is a basket and basket fastener combination for use in a shower stall. The combination includes a basket having a generally horizontal bottom surface and four generally vertical sides affixed to the bottom surface. The four sides and bottom surface form an enclosure for storing shower supplies. The basket also includes a plurality of perforations on at least one of the vertical sides. In addition, the combination also includes an appendage attached to the shower stall and a basket fastener attached to the appendage. The basket fastener includes a first end and a second end, each end having a prong, whereby the prongs are inserted into the plurality of perforations of the basket to support the basket on the appendage of the shower stall by the basket fastener.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

A shower seat and basket combination for storing shower supplies is disclosed.

Figure 1:
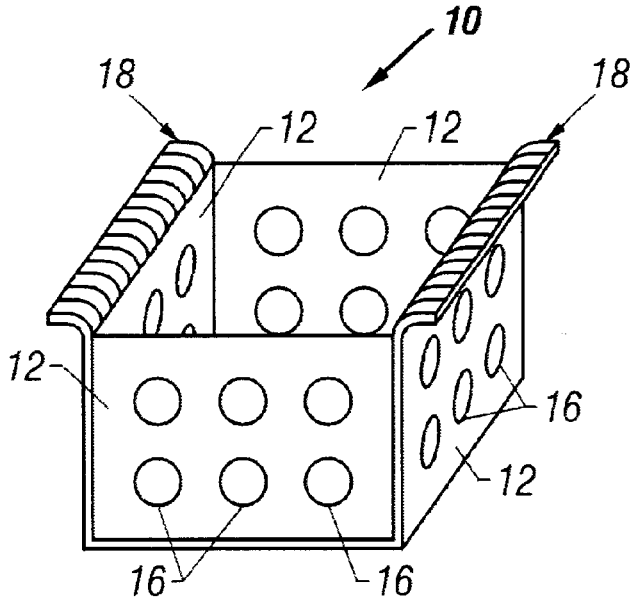
FIG. 1 is a perspective view of a basket in the preferred embodiment of the present invention.

FIG. 1 is a perspective view of a basket 10 in the preferred embodiment of the present invention. The basket includes four vertical sides 12 and a horizontal bottom surface 14 (FIG. 2) forming an enclosure for holding shower supplies. As illustrated in FIG. 1, the four sides and bottom surface may optionally include a plurality of perforations 16. In addition, the basket includes two overhanging edges 18 extending outwardly from an interior portion of the basket and running the length of a top portion of the basket. Each overhanging edge is located on an opposing side of the top portion of the basket. The basket may be constructed of any material which can withstand constant exposure to water, such as plastic.

Figure 2:
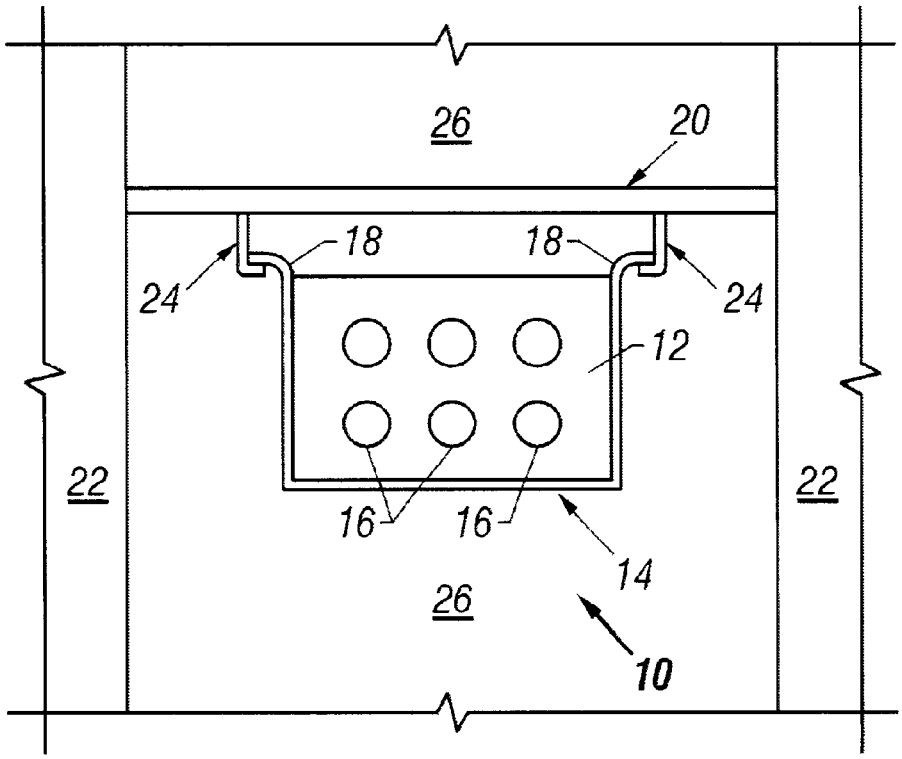
FIG. 2 is a front view of the basket of FIG. 1 attached to an underside of a shower seat in a first embodiment of the present invention.
Figure 3:
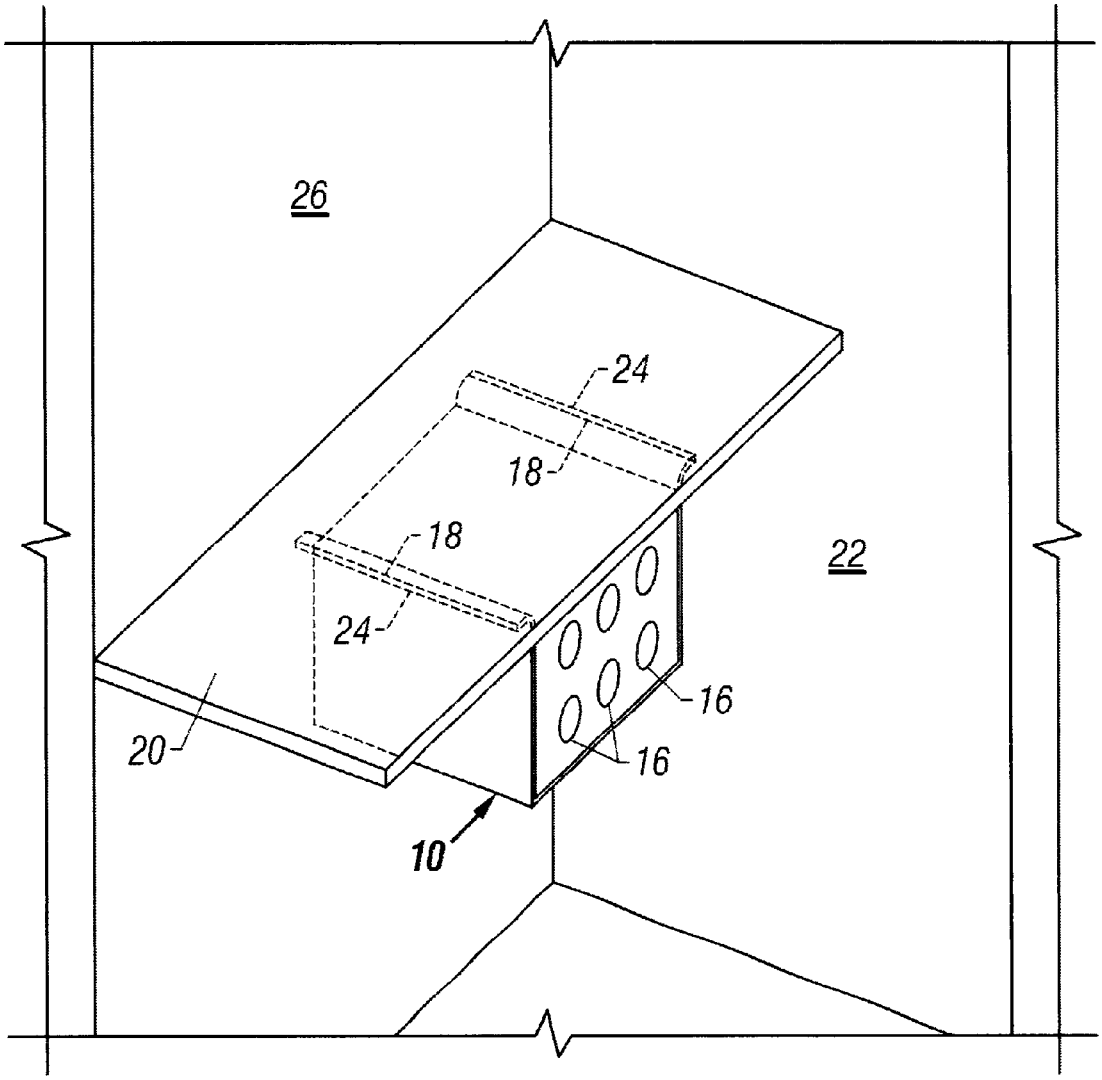
FIG. 3 is a perspective view of the shower seat of FIG. 2 with the basket and railings in phantom in a closed position.
Figure 4:
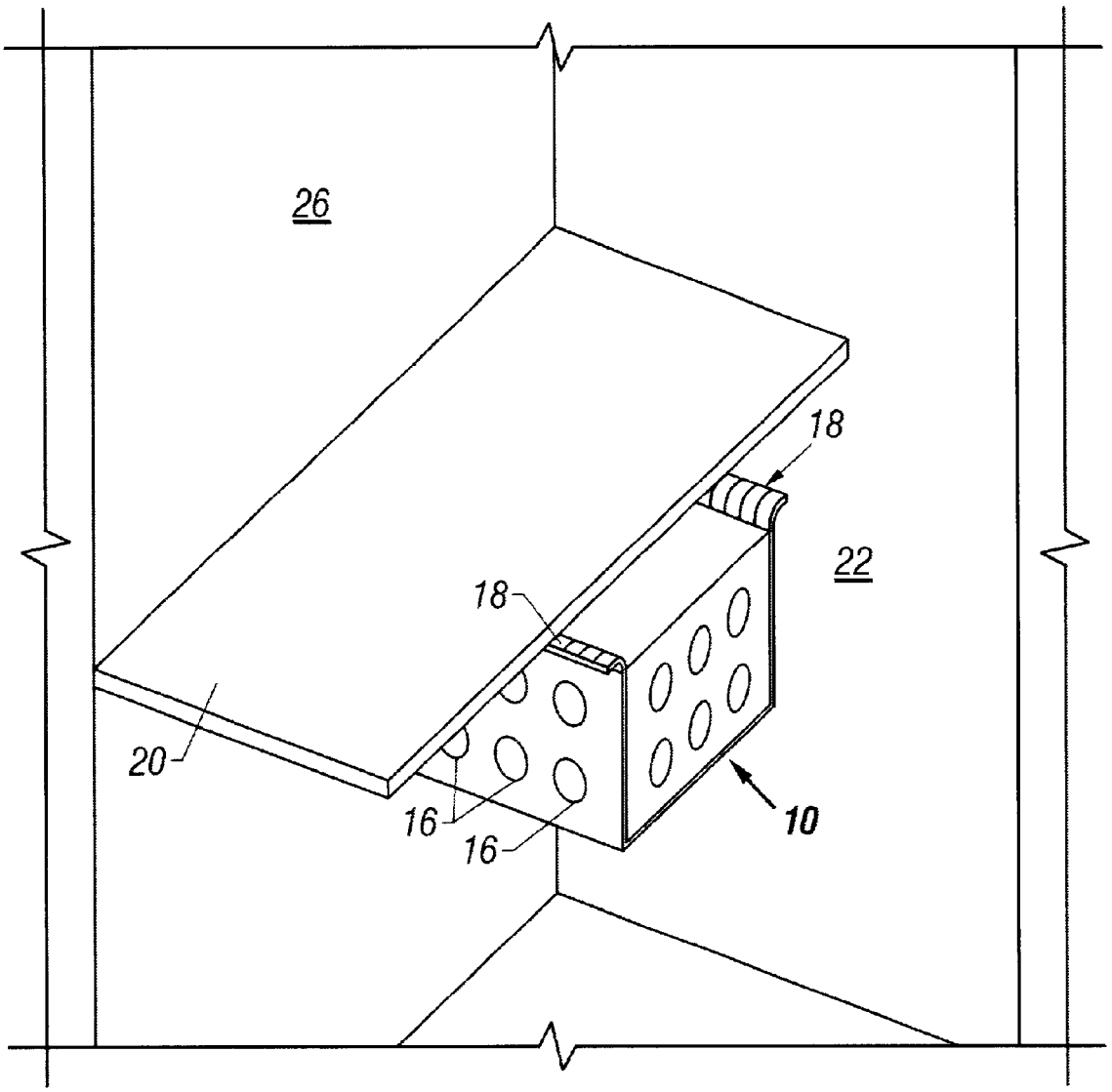
FIG. 4 is a perspective view of the shower seat of FIG. 2 with the basket in an opened position.

FIG. 2 is a front view of the basket 10 of FIG. 1 attached to an underside of a shower seat 20 in a first embodiment of the present invention. The shower seat is permanently affixed and supported by the walls 22 of a shower stall. The shower seat provides a sitting area for a person using the shower stall. As illustrated in FIG. 2, the shower seat is a single slab of waterproof material, such as marble or tile. Although FIG. 2, 3, and 4 illustrate a rectangularly-shaped shower seat, the shower seat may be any shape and size large enough to accommodate a person using the shower. The shower seat 20 may be attached to the walls 22 by a variety of means. On the underside of the shower seat is two railings 24 running the width of the shower seat towards a back wall 26. The railings, in the preferred embodiment of the present invention, are at least the same length as the overhanging edges 18 of the basket 10. The railings 24 are attached to the underside of the shower seat 20 in such a manner that the railings can support the weight of the basket and any shower supplies. For example, the railings can be bolted, nailed or glued to the underside of the shower seat. The railings may be constructed of any material providing a rigid surface. In the preferred embodiment, the material is adapted for use in water, such as a plastic. As illustrated in FIG. 2, the railings support the basket by supporting the overhanging edges. Although the railings are used in the preferred embodiment, any means may be utilized which can support the overhanging edges of the basket.

FIG. 3 is a perspective view of the shower seat 20 of FIG. 2 with the basket 10 and railings 24 in phantom in a closed position in the first embodiment of the present invention. FIG. 4 is a perspective view of the shower seat 20 of FIG. 2 with the basket in an opened position in the first embodiment of the present invention.

Referring to FIGS. 1–4, the present invention will now be explained. The basket 10 is positioned so that the overhanging edges 18 are supported by the railings 24. Within the basket's interior is placed shower supplies such as soaps and shampoo. Normally, the basket is positioned so that the entire basket is underneath the shower seat. When any shower supplies are needed, the basket is slid outwardly from the shower seat, allowing access to the interior of the basket. Once the desired shower supply is retrieved, the basket is slid back underneath the shower seat. Since the basket and its contents are constantly exposed to water, in the preferred embodiment, the basket includes the plurality of perforations 16. The plurality of perforations allow water to drain from the shower supplies and basket. Additionally, air is allowed to enter into the interior of the basket, thereby allowing the contents of the basket to air dry.

Figure 5:
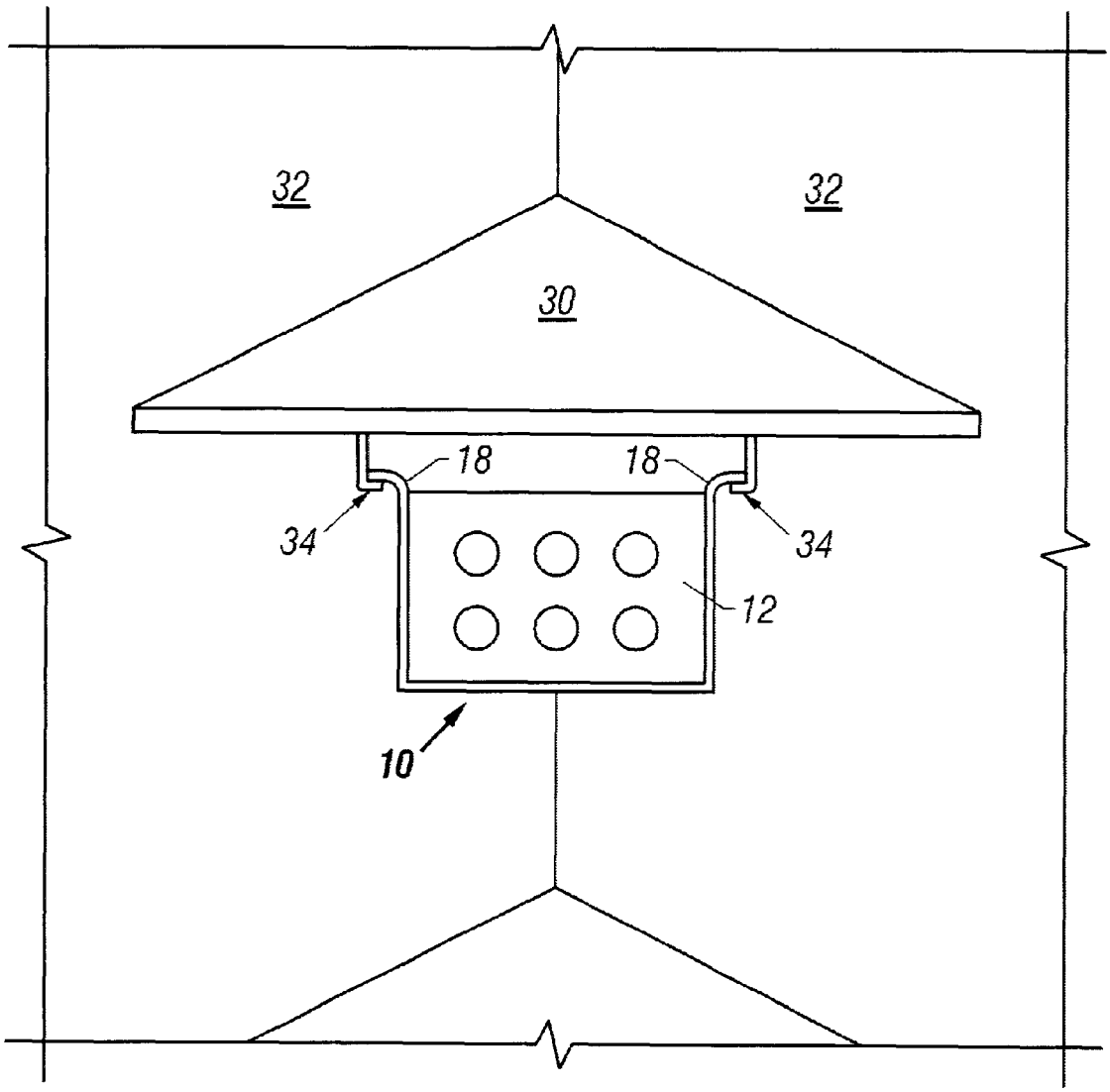
FIG. 5 is a perspective view of the basket attached to a shower seat in a closed position in an second embodiment of the present invention.

FIG. 5 is a perspective view of the basket 10 attached to a shower seat 30 in a closed position in a second embodiment of the present invention. In this second embodiment, the shower seat is shaped and affixed to the walls 32 as disclosed in the Utility patent application Ser. No. 09/226,385. On the underside of the shower seat is railings 34 which provide a lip to support the overhanging edges 18 of the basket. In a manner similar to FIGS. 2–4, the basket may be slid outwardly or inwardly as desired from the shower seat.

Figure 6:
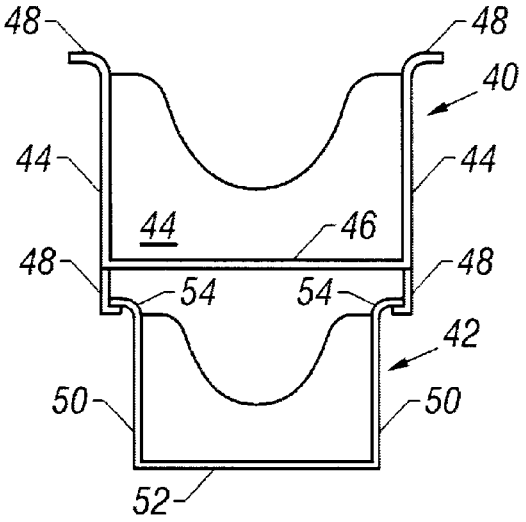
FIG. 6 is a front view of a basket attached to another basket in a third embodiment of the present invention.

FIG. 6 is a front view of a basket 40 attached to a basket 42 in a third embodiment of the present invention. The basket 40 includes four vertical sides 44 and a horizontal bottom surface 46 forming an enclosure for holding shower supplies. The basket 40 also includes two overhanging edges 48 extending outwardly from an interior portion of the basket and running the length of a top portion of the basket 40. Basket 40 is identical to basket 10 with the exception of basket 40 having railings 48 located on the bottom surface 46. Basket 42 includes vertical sides 50, a bottom surface 52, and two overhanging edges 54. Although not illustrated in FIG. 6, the baskets 40 and 42 may optionally include a plurality of perforations as described above.

In operation, the basket 40 is positioned under a shower seat as described in FIGS. 1–5. Basket 42 may also be placed underneath the basket 40 and supported by the railings 48 of the basket 40 in a similar fashion as the basket 40 is supported by the shower seat. The basket 42 may be slid outwardly for retrieval of shower supplies placed within the interior of the basket 40. In other embodiments, the basket 42 may be supported by the basket 40 by any means which supports the basket 42 in place, such as fasteners or brackets. Additionally, the basket 42 may be permanently affixed to the basket 40. Although two baskets are illustrated in FIG. 6, a series of baskets may also be used, one under another in a stacking manner beneath a shower seat. The use of a plurality of baskets allows additional storage space for shower supplies.

Figure 7:
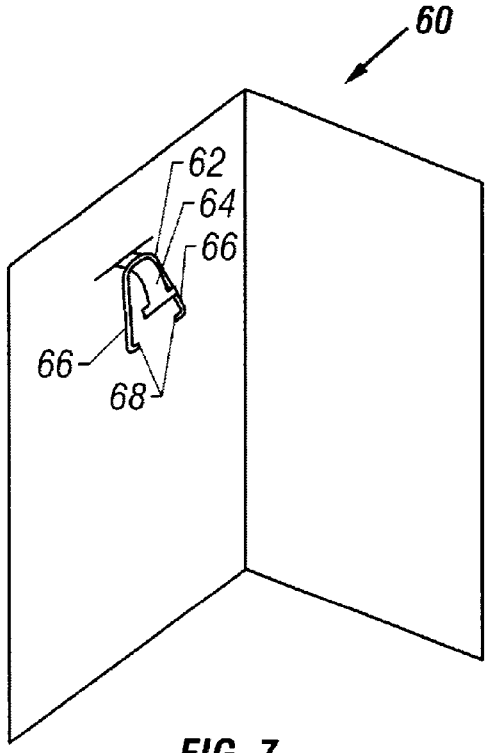
FIG. 7 is a perspective view of a shower stall illustrating a basket fastener attached to a shower head.

FIG. 7 is a perspective view of a shower stall 60 illustrating a basket fastener 62 attached to a shower head 64. The basket fastener 62 is a strip of material constructed of a flexible material such as metal having two ends 66. In the preferred embodiment of the present invention, each end 66 has a prong 68 deflected at an angle from the end 66. The basket fastener is attached to the shower head by shaping the basket fastener around the neck of the shower head, either in a tight "U" (FIG. 7), or by completely wrapping the basket fastener around the neck of the shower head.

Figure 8:
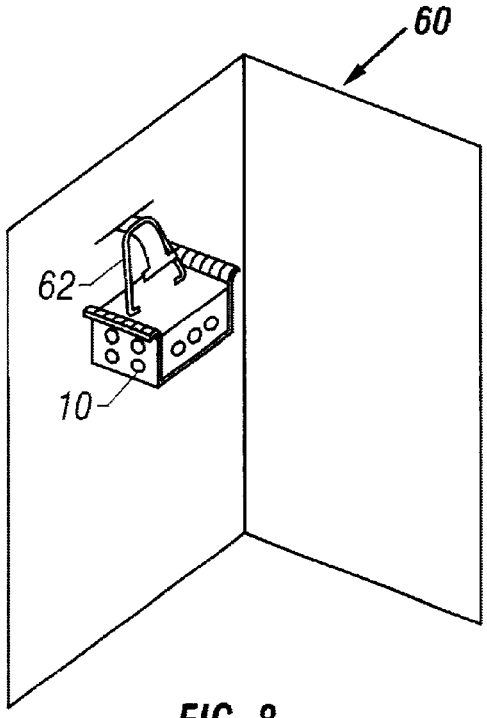
FIG. 8 is a perspective view of the shower stall illustrating the basket of FIG. 1 attached to the shower head by the basket fastener.

FIG. 8 is a perspective view of the shower stall 60 illustrating the basket of FIG. 1 attached to the shower head 64. The basket 10 may be removed from the underside of a shower seat and attached to the shower head by the basket fastener 62. Each prong 68 may be inserted into a perforation 16 on one vertical side 12. Since each prong is deflected at an angle, the prongs can support the basket. The flexible material of the basket fastener 62 allows easy insertion and removal of the prongs within the perforations of the basket. The basket, when fastened to the basket fastener, rests against a wall of the shower stall, allowing easy access to the supplies within the interior of the basket. The basket fastener may also be fastened to other appendages located within the shower stall, such as the water control handles. During showering, the basket is removed from underneath the shower seat and fastened by the basket fastener to the shower head. This provides easy access to the bather to the supplies.

When showering is complete, the basket can be removed from the shower head and placed unobtrusively underneath the shower seat.

The basket 10 and its attachment to the shower seat provide several advantages. The basket allows shower supplies to be stored in a convenient location which is easily accessible to a user. The basket provides a central location where all the shower supplies can be kept, thus reducing the likelihood of losing the shower supplies. In addition, by positioning the basket in an area which is not used by a person showering, valuable shower space is not lost to accommodate the basket. The basket also allows the shower supplies to dry quickly by allowing the perforations to drain the water from the basket, as well as allowing air to enter the interior of the basket for air drying. In addition, the basket may be easily and inexpensively mounted to existing shower seats.

It is thus believed that the operation and construction of the present invention will be apparent from the foregoing description. While the combination described has been characterized as being preferred, it will be readily apparent that various changes and modifications could be made therein without departing from the scope of the invention as defined in the following claims.

What is claimed is:

1. A basket and shower seat combination for use in a shower stall, the combination comprising:

a shower seat assembly comprising:

a cultured single pour marble slab;

a shower stall having a plurality of vertical wall studs attached to a backboard of the shower stall where a horizontal corner strip of backboard has been removed to form a slot, whereby a back portion of the marble slab is inserted into the corner slot such that the edges are against the vertical wall studs;

a plurality of tiles attached to the backboard adjacent a top side of the slab; and a plurality of tiles attached to the backboard adjacent a bottom side of the slab, whereby the slab rests on the tiles adjacent the top side and the bottom side of the slab and the backboard;

a basket slidably mounted to the bottom side of the slab, said basket having:

a generally horizontal bottom surface;

four generally vertical sides affixed to the bottom surface, the four sides and bottom surface forming an enclosure for storing shower supplies; and two overhanging edges extending outwardly from a top portion of two opposing sides of the basket; and means for slidably supporting the two overhanging edges of the basket on the bottom side of the slab.

2. The combination of claim 1, wherein the means for slidably supporting the two overhanging edges of the basket is two railings mounted on the underside of the marble slab, each railing forming a lip to support each overhanging edge of the basket.

3. The combination of claim 1, further comprising a plurality of perforations on the four sides of the basket.

4. The combination of claim 1, further comprising a plurality of perforations on the bottom surface of the basket.

5. A shower stall seat assembly comprising:

a rigid slab in a substantially horizontal position;

a shower stall consisting of vertical wall studs attached to a backboard where a horizontal corner strip of backboard has been removed to form a slot at approximately the desired height for the shower seat;

tiles are attached to the backboard such that the top of the top row of tile is at the bottom level of said corner slot, a portion of said slab is then inserted into said corner slot such that the edges are against the structural supporting studs and said slab rests on the tile and the backboard;

tiles are then attached to the backboard around and on top of said marble slab and grouted in place;

a basket slidably mounted to the bottom side of the slab, said basket having:

a generally horizontal bottom surface;

four generally vertical sides affixed to the bottom surface, the four sides and bottom surface forming an enclosure for storing shower supplies; and two overhanging edges extending outwardly from a top portion of two opposing sides of the basket; and means for slidably supporting the two overhanging edges of the basket on the bottom side of the slab.

* * * * *